US005781637A

United States Patent [19]

Heide et al.

[11] Patent Number: 5,781,637

[45] Date of Patent: Jul. 14, 1998

[54] METHOD FOR FABRICATING A HEARING AID FACEPLATE AND A FACEPLATE PRODUCED THEREBY

[75] Inventors: Jorgen Heide, El Granada; Ole Riis Olsen, Pleasanton, both of Calif.

[73] Assignee: Resound Corporation, Redwood City, Calif.

[21] Appl. No.: 760,687

[22] Filed: Dec. 4, 1996

Related U.S. Application Data

[62] Division of Ser. No. 527,887, Sep. 14, 1995.

[51] Int. Cl.[6] ..... H04R 25/00

[52] U.S. Cl. ..... 381/68.6; 381/69; 381/69.2; 181/135; 181/130

[58] Field of Search ..... 381/68.6, 69, 68, 381/69.2; 181/135, 129, 130; 264/496, 222, 265, 278; 29/407.5

[56] References Cited

U.S. PATENT DOCUMENTS

| | | | |
|---|---|---|---|
| 2,203,105 | 6/1940 | Roberts | 264/222 |
| 2,950,357 | 8/1960 | Mitchell et al. | 381/68.6 |
| 4,476,353 | 10/1984 | Haertl | 381/68.6 |
| 4,569,812 | 2/1986 | Werwath et al. | 264/222 |
| 4,598,177 | 7/1986 | McGroarty et al. | 381/68.6 |
| 4,652,414 | 3/1987 | Schlaegel | 264/222 |
| 4,712,245 | 12/1987 | Lyregaard | 264/DIG. 30 |
| 4,800,636 | 1/1989 | Topholm | 29/169.5 |
| 4,828,777 | 5/1989 | Birkholz | 264/222 |
| 4,860,362 | 8/1989 | Tweedle | 381/69 |
| 5,146,051 | 9/1992 | Hermann | 264/DIG. 30 |
| 5,257,315 | 10/1993 | Haertl et al. | 381/68.6 |
| 5,531,954 | 7/1996 | Heide et al. | 264/DIG. 30 |

FOREIGN PATENT DOCUMENTS

| | | |
|---|---|---|
| 3613165C1 | 8/1987 | Germany . |
| WO92/04171 | 3/1992 | WIPO . |

*Primary Examiner*—Sinh Tran

*Attorney, Agent, or Firm*—Burns, Doane, Swecker & Mathis, L.L.P.

[57] ABSTRACT

A method for forming a standardized faceplate for an individually adapted in-the-ear hearing aid shell which matches the physical characteristics of the hearing aid user's ear, and for fabricating an individually-adapted in-the-ear hearing aid shell made of radiation-reactive material and a battery compartment therein.

4 Claims, 7 Drawing Sheets

METHOD FOR FABRICATING A HEARING AID FACEPLATE AND A FACEPLATE PRODUCED THEREBY

This application is a divisional of application Ser. No. 08/527,887, filed Sept. 14, 1995.

FIELD OF THE INVENTION

The invention relates generally to the fabrication of hearing aid faceplates, and more particularly to a method for fabricating a standardized faceplate for attachment to an individually adapted in-the-ear hearing aid housing.

BACKGROUND OF THE INVENTION

In-the-ear hearing aids (i.e., hearing aids housed entirely within the ear canal and ear cavity) are popular because they are relatively inconspicuous. To further conceal the hearing aid, typically the color of the hearing aid housing or shell and the contours of its faceplate are hand-sculptured to closely match the color and contours of the hearing aid user's ear. Many current hearing aid shells are made of monomer or polymer mixtures which are colorizable and can be handcarved so that the faceplate can be custom made to closely match the individual user's ear cavity. However, these prior art hearing aid shells and faceplates are costly to manufacture and are not capable of mass production for a couple of reasons. First, unlike other fusible materials, monomer and polymer can usually only be hand-caste. Secondly, hand-carving of the faceplate is very time consuming.

There are other prior art methods of shell fabrication that employ radiation-reactive materials and automated ultraviolet curing techniques and apparatuses which can mass produce shells at a lower cost. These methods are especially successful in the fabrication of thin-walled shells for various applications and for in-the-ear hearing aids. The invention disclosed in PCT Application No. DK 91/00257 having Publication No. WO 9204171 (the "Olsen application") provides one particular method and apparatus for producing such thin-walled, individually-adapted hollow housings or shells for in-the-ear hearing aids. The invention disclosed in U.S. patent application Ser. No. 08/286,522 (the "Heide application") provides a method for producing customized faceplates for use with such thin-walled shells. While the methods and apparatus disclosed in the Olsen and Heide applications are advantageous in the curing of shells and producing customized faceplates, there is a need for a method for producing standardized faceplates for use with customized shells. It is therefore desirable to provide a method of fabricating standardized faceplates to be used in conjunction with the general methods described in the Olsen application or in conjunction with other methods to produce in-the-ear hearing aids.

The majority of conventional in-the-ear hearing aid shells are designed such that the battery is housed just under the faceplate and the battery door is located on the outer surface of the faceplate. Although this design is the easiest to manufacture and facilitates access to the battery, it makes the faceplate less natural looking. Thus, it is desirable to provide a method of fabricating a standardized faceplate, to be attached to a sculptured shell with access to the battery compartment at a location that does not require access through the faceplate yet one that does not require a lot of time or skill to produce.

SUMMARY OF THE INVENTION

Application of the method of the present invention achieves the objective of providing a standardized faceplate that is less conspicuous and less costly to manufacture than prior art faceplates to be used with an in-the-ear sculptured hearing aid shell having a battery compartment located at the backside of the shell. The standardized faceplate is molded to match the color, contours and shape of the hearing aid user's ear.

In one embodiment of the present invention there is provided a method for fabricating a standardized faceplate having a contour representing a shape of a typical ear, comprising the steps of determining the contour, providing a casting form of the contour from which the standardized faceplate is made and casting the standardized faceplate in the casting form with a casting material.

In another embodiment of the present invention there is provided a method for forming a standardized faceplate for use with an individualized in-the-ear hearing aid shell which matches the physical characteristics of the hearing aid user's ear, comprising the steps of determining a surface shape for the standardized faceplate which represents a typical user's ear, forming an impression of the surface shape in molding material, conformally coating the impression with a radiation-reactive colored material such that the color of the colored material optimally matches the skin color of the hearing aid user, and curing the radiation-reactive colored material by means of an ultraviolet radiation process.

In yet another embodiment of the present invention there is provided a standardized faceplate representing a contour of a typical ear for use on a customized hearing aid, said faceplate comprising a ridge rising from a lower surface of the faceplate and extending from an outside edge of the faceplate to an intermediate position, the ridge representing a radix helicis of the typical ear, at least one raised contour rising from the lower surface spaced from the ridge and extending from the outside edge of the faceplate to a second intermediate position and a valley connecting the ridge to the raised contour, the valley representing a cavum conchae of the typical ear.

DETAILED DESCRIPTION OF THE DRAWINGS

Figure 16:
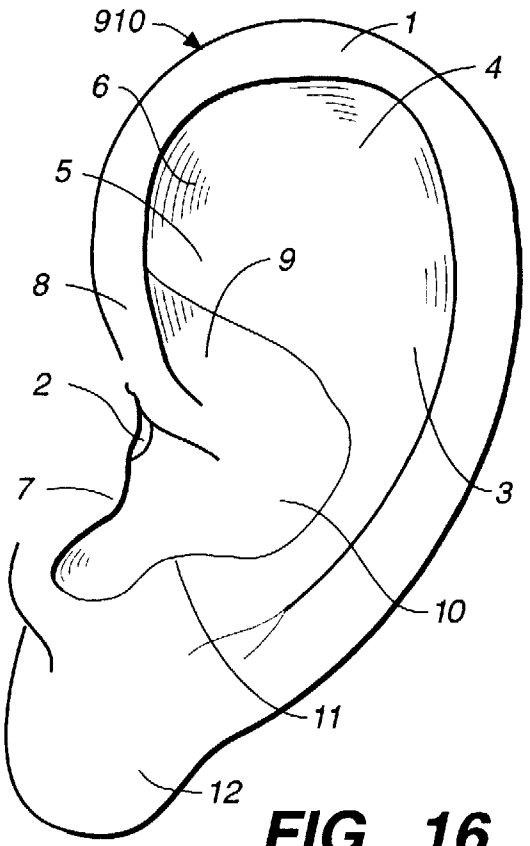
FIG. 16 is a side elevational view of a left ear.

Referring now to the figures in which like reference numerals refer to like components, and initially to FIG. 16 in particular, there is illustrated a left ear having helix 1, meatus acoustics externus 2, anthelix 3, crus superius anthelicis 4, crus inferius anthelicis 5, fossa triangularis 6, tragus 7, radix helicis 8, cimba conchae 9, cavum conchae 10, antitragus 11, and lobulus or lobe 12.

Figure 1:
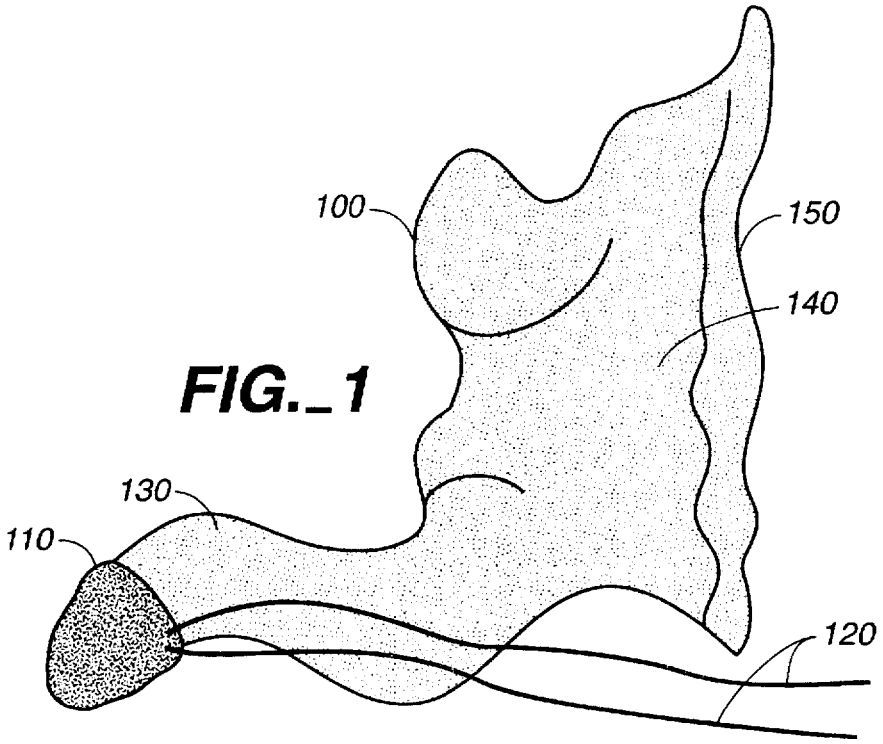
FIG. 1 is a side elevational view of an impression of a typical hearing aid user's ear canal and cavity.

Referring now to the remaining figures, in particular to FIG. 1 initially, there is shown a negative impression 100 of the ear cavity and ear canal of a left ear of a hearing aid user. For purpose s of this discussion, illustrations of the ear, hearing aid shells and faceplates are of and for the left ear. All of the methods and resulting products are equally applicable to the right ear. Impression 100 is formed by an injection procedure commonly known by those of ordinary skill in the art for fabricating hearing aid shells. Here, silicon, or another suitable material having similar properties, is injected into the user's ear canal, filling the ear canal and ear cavity to the outer ear. Prior to the injection procedure, a plug 110 of absorbent material having a string or pair of strings 120 attached thereto is placed in the user's ear canal, just past the second bend of the ear canal. Plug 110 prevents the silicon from traveling too far into the ear canal. String 120 allows the impression 100 to be pulled out of the ear once it has sufficiently dried. Sections 130 and 140 of impression 100 are the impressions of the ear canal and ear cavity, respectively.

Figure 2:
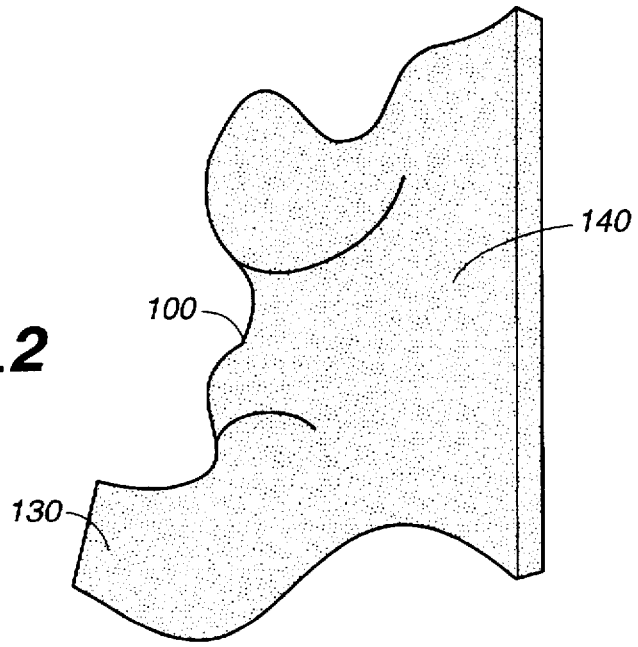
FIG. 2 is a side elevational view of the impression of FIG. 1 after being trimmed.
Figure 3:
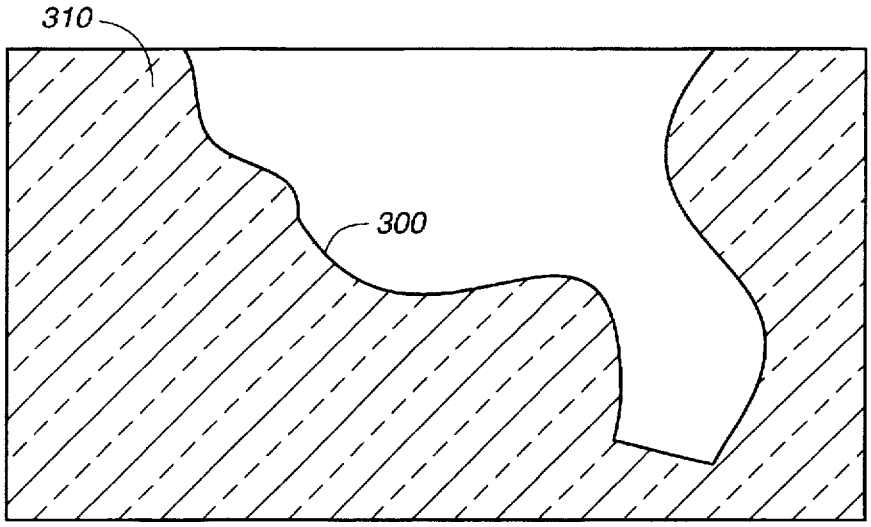
FIG. 3 is a schematic sectional view of a positive mold of the trimmed impression of FIG. 2.

From this negative impression, positive molds of the ear canal and cavity are made by techniques commonly used in the art. First, a mold (not shown), preferably made of silicon, is made for the purpose of checking the fit of the finished shell and faceplate. Next, as shown in FIG. 2, the negative impression 100 is trimmed to eliminate portions of the impression that are not necessary for forming the shell and attaching the faceplate. Specifically, the tip of the ear canal section 130 is removed and the side 150 of the ear cavity section 140 is trimmed and leveled. From this trimmed negative impression, a positive mold 300, shown cross-sectionally in FIG. 3, is formed in molding material 310. The molding material is usually transparent so as to allow for a radiation step (described later) in the fabrication process. Colloid is ideally suited for this purpose and is also less expensive than silicon as colloid can be melted and reused for future molds.

Figure 4:
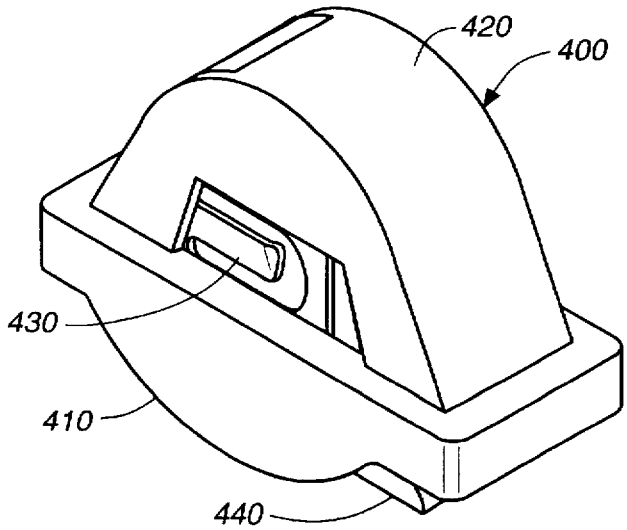
FIG. 4 is a perspective view of the battery compartment subassembly of a hearing aid.

Referring now to FIG. 4, there is illustrated a perspective view of an exemplary battery compartment subassembly 400 used to demonstrate the method of the present invention. Subassembly 400 comprises battery boot 410, battery cover 420, positive and negative electrical contacts 430 (only one is visible), and battery door 440. It is within the scope of the present invention to employ varying shapes and sizes of battery compartment subassemblies and batteries to implement the disclosed method. For implementation of one of the preferred embodiments of the present invention, a battery boot is used, made of nylon or tinaet or other materials that will not react with or stick to ultraviolet radiation-reactive material when cured.

Figure 5:
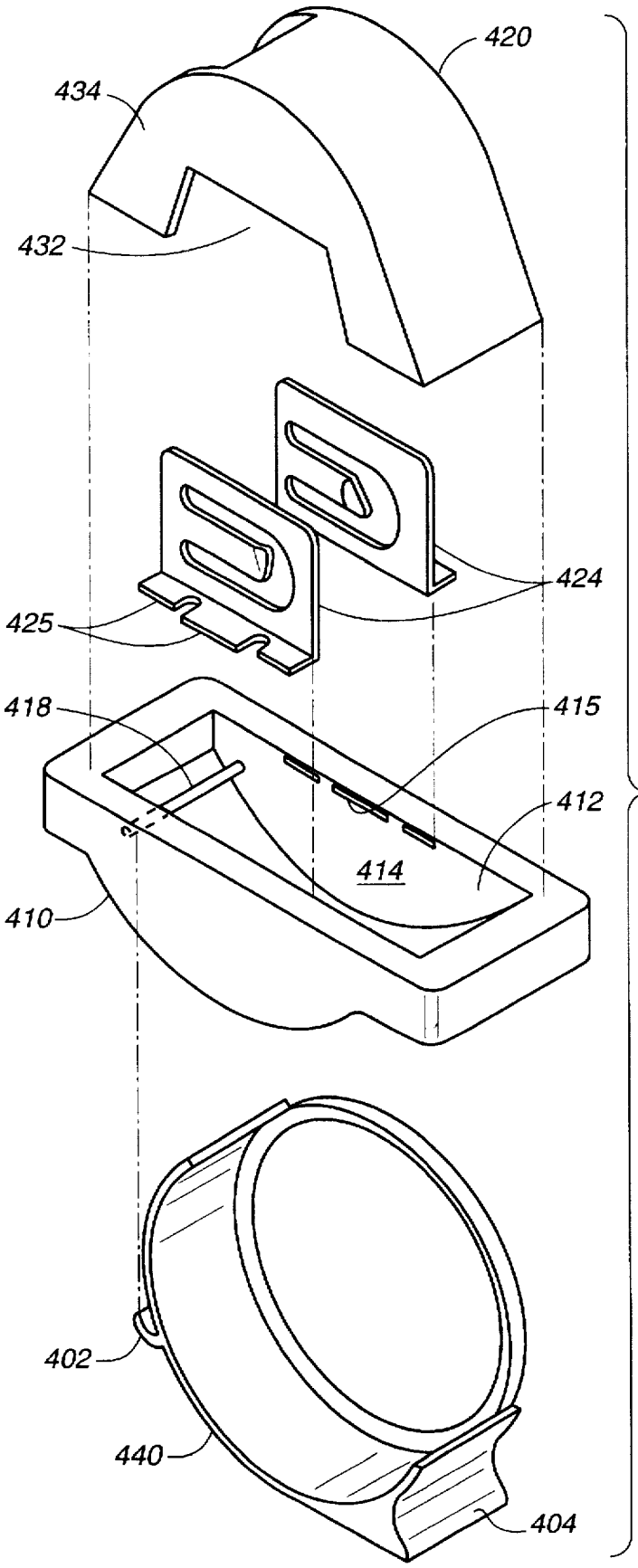
FIG. 5 is an exploded perspective view of the battery compartment subassembly illustrated in FIG. 4.

FIG. 5 shows an exploded view of the battery compartment of FIG. 4. A small disk-shaped battery (not shown) commonly used to power hearing aids is cradled within cylindrical battery door 440. The battery and battery door 440 can be positioned into opening 412 of battery boot 410 such that the electrical positive and negative sides of the battery touch conductive contacts 424. These conductive contacts fit securely within the inner sides 414 (only one of which is visible) by means of prongs 425 on the conductive contacts 424 and corresponding slits 415 located in the inner sides 414. A pin or hinge 418 is positioned perpendicularly to and between inner sides 414 and toward one end of battery boot 410. Pin 418 interlocks with clip 402 on battery door 440 such that when the clip is coupled with the pin, the battery door 440 can be rotated downward and away from battery boot 410. The half cylinder-shaped battery cover 420 having window 432 on each of its sides 434 can then be positioned over the battery. Windows 432 allow the conductive contacts 424 to be electrically coupled to the electronic components (not shown in this figure) of the hearing aid.

Figure 6:
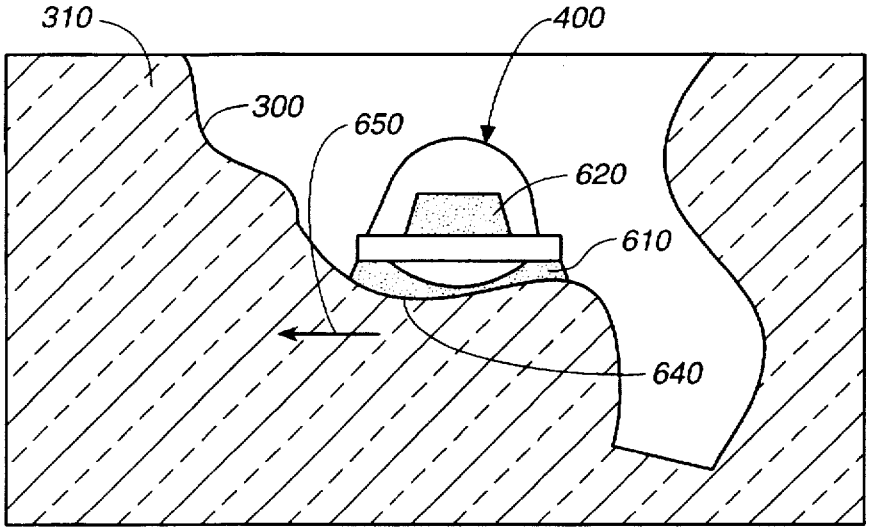
FIG. 6 is a schematic sectional view of the battery compartment subassembly of FIGS. 4 and 5 positioned within the positive mold of FIG. 2.

After forming the positive mold 300 of the trimmed negative impression 100, the next step is to cast the hearing aid shell with casting material. In one embodiment of the present invention, the casting material is made of ultraviolet (UV) radiation-reactive material (for example, CAS 56744-60-6). Prior to positioning the battery compartment subassembly 400 within the mold, preliminary preparations are necessary to ensure that the battery contacts are prevented from coming into contact with the casting material. These preliminary preparations are illustrated in FIG. 6.

Figure 14:
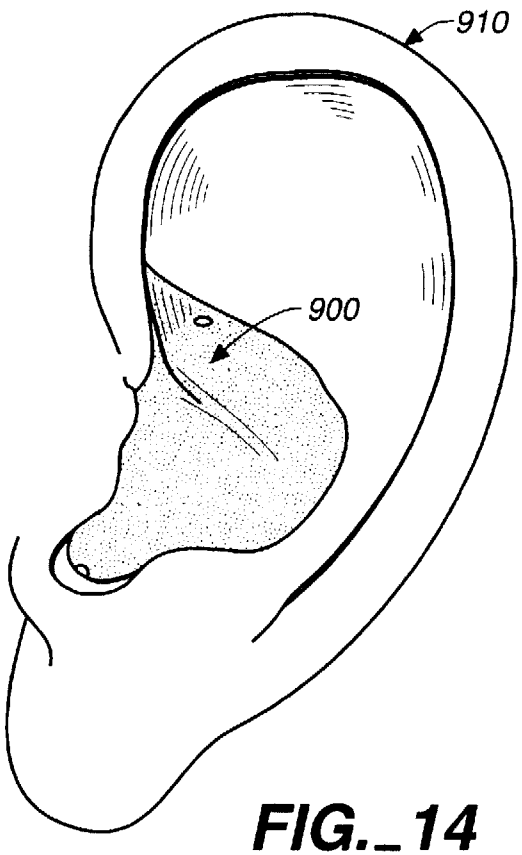
FIG. 14 is a side elevational view of the hearing aid housing worn in a left ear.

The battery door (not visible) in its closed position and conductive contacts (not visible) of the assembled battery compartment subassembly 400 (without an enclosed battery) position are covered with a small amount of colloid material 610 and 620. Colloid material 620 protects the battery contacts from coming in contact with the casting material during the casting step so as to maintain the battery contacts'conductive properties. The battery compartment subassembly 400 is then placed within the positive mold 300 with the battery door and the overlying colloid material 610 facing downward and sitting on "bowl" 640 (i.e., the portion of the impression made along the user's cavum conchae 10; refer to FIG. 16) of positive mold 300. The door catch (not shown in FIG. 6 but illustrated at 404 in FIG. 5), points in the direction of arrow 650 (i.e., generally perpendicular to a line extending through the radix helicis 8) when located in the ear as illustrated in FIG. 14.

Preferably, battery subassembly 400 is pressed downward until the colloid material 610 hardens. The subassembly 400 is then removed from positive mold 300. A cutting instrument, ideally a razor blade, can be employed to cut away the unnecessary colloid material which surrounds the perimeter of the battery door. The purpose of colloid material 610 being coated over the battery door is to ensure that the door is slightly recessed from or flush with the outer surface of the resulting hearing aid shell after the radiation step such that the battery door will not irritate or chaff the user's ear when the hearing aid is in use. The battery subassembly 400 is replaced in the bowl 640 within the positive mold 300 after the unnecessary colloid material is cut away. Liquid radiation-reactive material is then poured into the positive mold 300 to fill the entire cavity. Common radiation-reactive materials based on a bisphenol-A-dimethacrylate initiated with photoinitiators and pigmented with ironoxide-red and yellow colors can be used. The radiation-reactive material is then cured with ultra-violet radiation. Inert gasses (commonly $CO_2$) are injected to assist with surface curing of the part.

Figure 7:
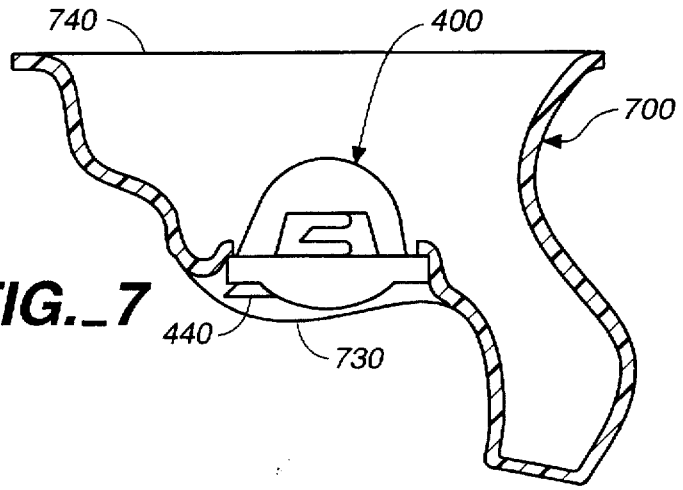
FIG. 7 is a schematic sectional view of the hearing aid shell produced by a method of the present invention.

This method produces a thin-walled hearing aid shell 700 of radiation-reactive material, illustrated in FIG. 7. Battery door 440 of battery subassembly 400 can now be opened from the outside of shell 700. As can be seen, battery door 440 does not protrude beyond surface 730 of shell 700 so as to fit comfortably against a user's cavum conchae within the ear cavity.

At this point in the process, the top perimeter 740 of shell 700 is leveled and cut to reduce the height of the shell such that when the faceplate disk 20, to be described in more detail below, is attached to the trimmed perimeter 740, the contours of the standardized faceplate disk 20 replicate those of the individual user's ear. At all points on the trimmed perimeter 740, the height of shell 700 is no lower than the highest point of battery cover 420 and the shell is essentially level.

Figure 12:
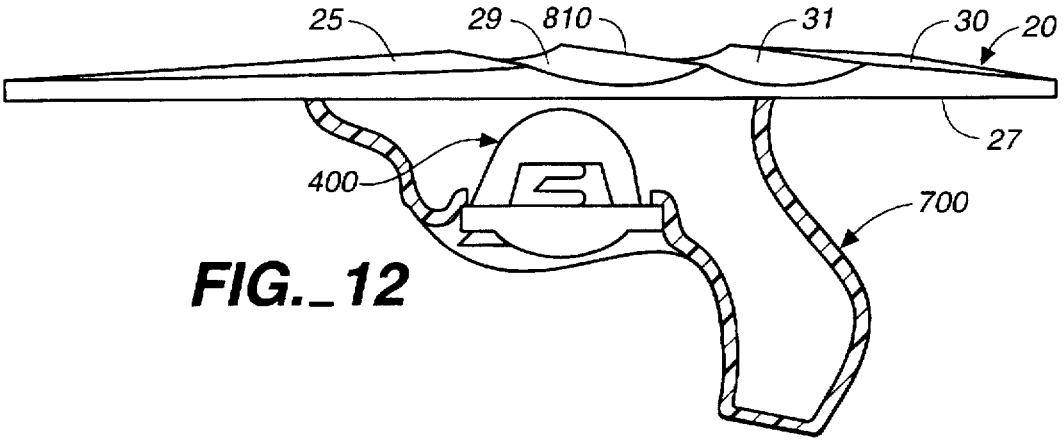
FIG. 12 is a schematic view, partially in cross-section, of the battery compartment subassembly and hearing aid shell of FIG. 7 after the shell height has been reduced with a standardized faceplate placed thereon.
Figure 8:
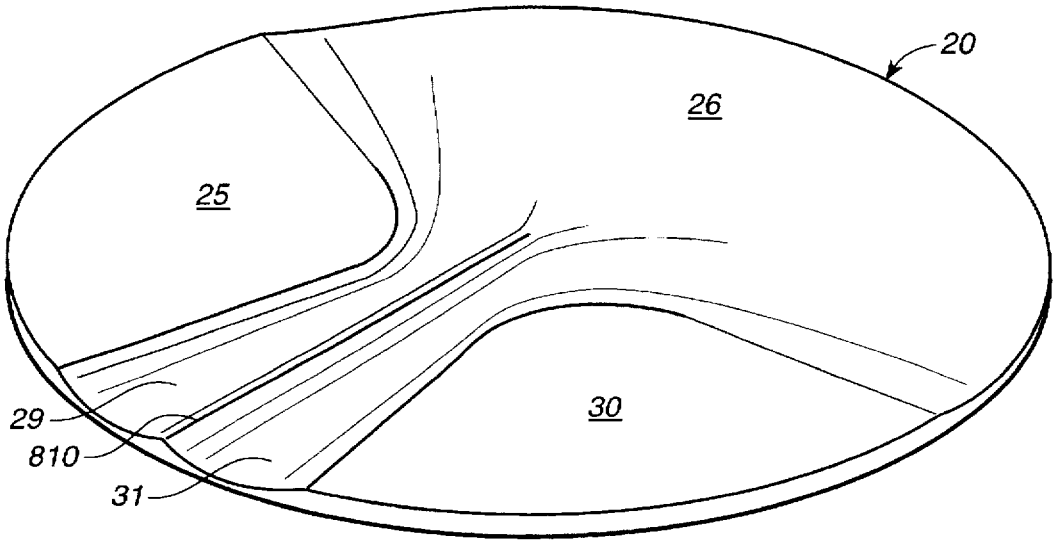
FIG. 8 is a perspective view of a standardized faceplate in accordance with one embodiment of the present invention.

Referring now to FIG. 8, a standardized faceplate disk 20 is shown. The faceplate disk 20 is formed using a very similar process as used for forming the shell 700. Briefly, a standardized negative impression is hard-sculpted to meet a set of dimensions representing the dimensions of a generalized population of user's ears. A casting form (or positive mold) is formed in molding material, such as colloid, of the negative impression. Standardized faceplate disks 20 are made from the casting form by filling the casting form with casting material. In one embodiment, the casting material is ultraviolet radiation-reactive material. The standardized faceplate disks can also be injection molded. The color casting material is then cured with ultra-violet radiation forming a standardized faceplate disk 20, illustrated in FIGS. 8–11, which fits across the opening of shell 700 (FIG. 12).

The standardized dimensions for the faceplate disk 20 can be determined in many ways. For example, a plurality of hand-sculpted faceplates made using traditional techniques can be measured and statistically or empirically evaluated to determine a generalized contour for the disk. Typically, the ridge or rib that is formed on each of the hand-sculpted faceplates runs generally parallel to the user's cimba concha. Similarly, the height of the ridge is generally taller on larger faceplates. Comparing the hand-sculpted faceplates to a bisected circle, it can be seen that a tangent line to the edge of the contours of each of the faceplates on each side of the ridge typically varies by approximately 5° between the right and left side contours. The standardized dimensions can also be determined by measuring a plurality of individuals' ear contours and/or shapes and statistically or empirically determining a contour that generally represents the shape of a typical ear.

Referring to FIGS. 8–11, a ridge 810 replicating the user's radix helicis 8 is located on the upper surface 26 of the faceplate disk 20. Likewise, the raised contours 25 and 30 of the faceplate disk 20 are located on the upper surface on opposite sides of ridge 810 and shaped to match the user's cimba conchae 9, cavum conchae 10 respectively and other ear surfaces. Between the ridge 810 and raised contour 25 is a valley 29. Between the ridge 810 and raised contour 30 is a valley 31. Each valley is deeper at the edge of the faceplate disk than near the center of the disk, as can best be seen by comparing FIGS. 9A, 9B and 10. In other words, the depth of the valley is less near the center of the disk then at the outer edge of the disk. Similarly, each of the valleys are wider across at the outer edge of the disk than near the center of the disk. Ridge 810 and raised contours 25 and 30 extend about half way across the disk and then taper out into surface 26. Each of the raised contours covers about one fourth of the disks. Advantageously in one embodiment, the standardized disk 20 can be used on both the left and right ear hearing aids because the contours are generally symmetrical about an imaginary line passing along ridge 810.

Figure 9A:
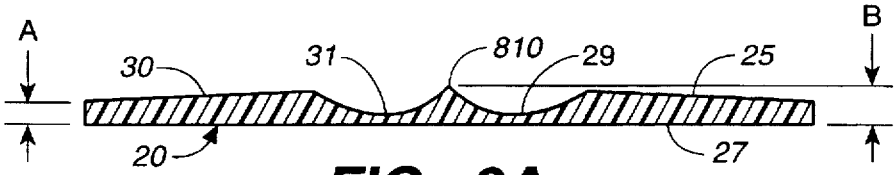
FIG. 9A is a cross-sectional view taken along line 9A—9A in FIG. 9.
Figure 9B:
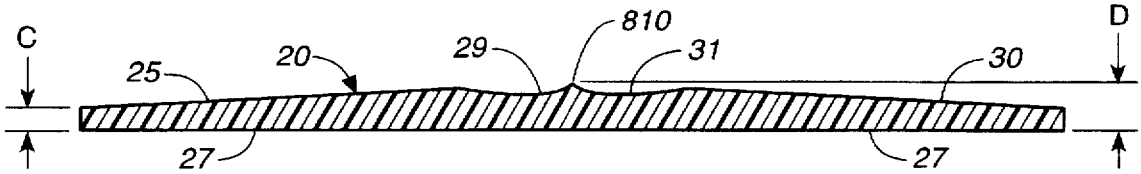
FIG. 9B is a cross-sectional view taken along line 9B—9B in FIG. 9 of the standardized faceplate only.
Figure 9C:
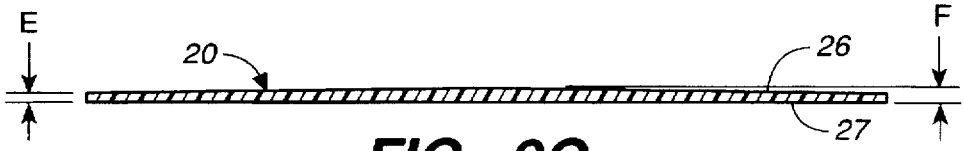
FIG. 9C is a cross-sectional view taken along line 9C—9C in FIG. 9.
Figure 9:
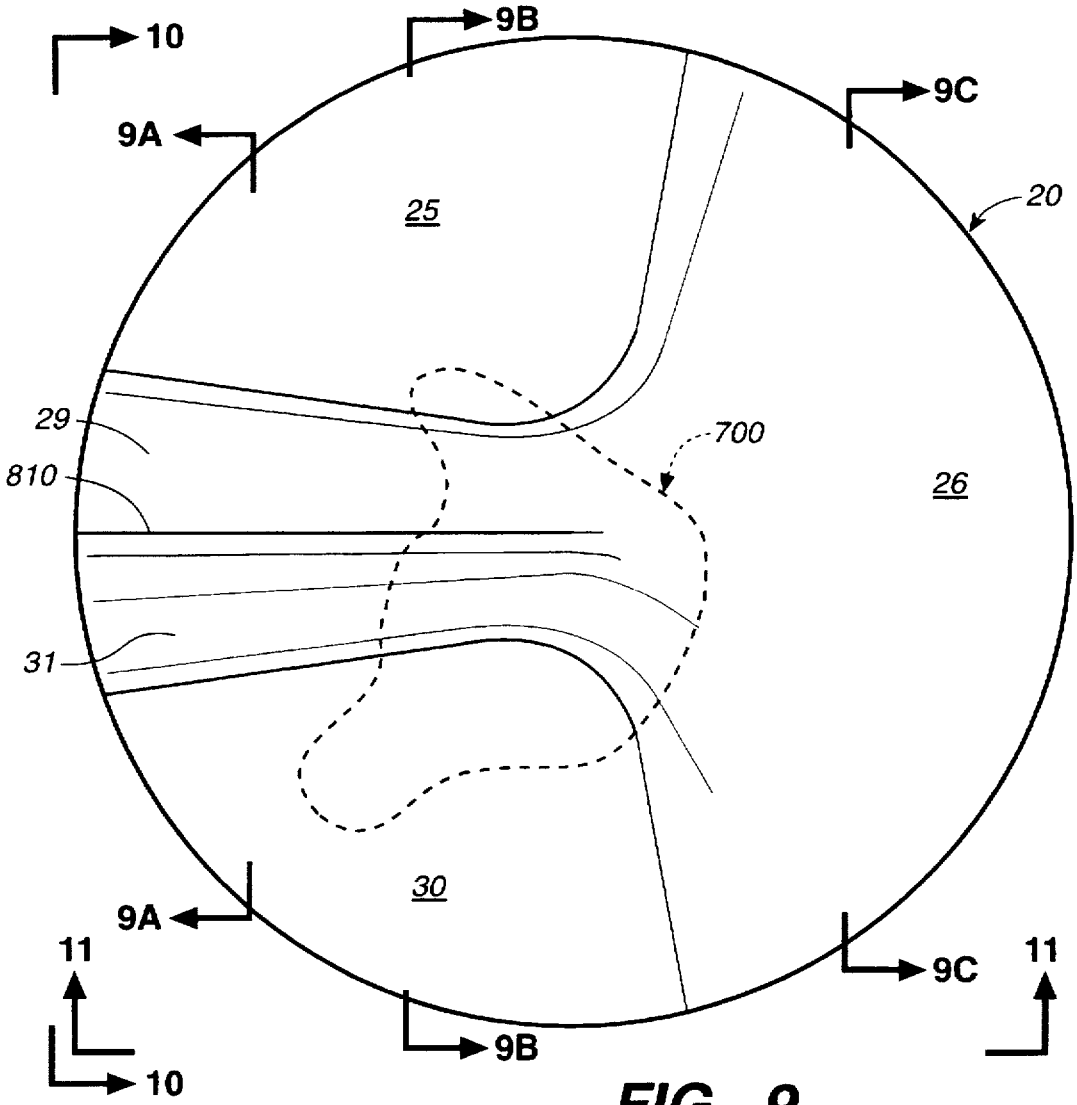
FIG. 9 is a top plan view of the standardized faceplate before being trimmed located on the hearing aid shell.
Figure 10:
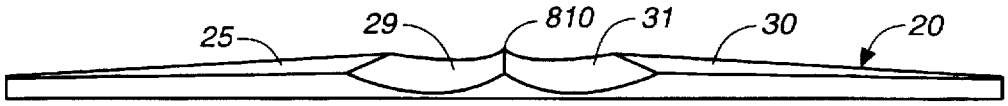
FIG. 10 is an elevational view along line 10—10 in FIG. 9.
Figure 11:
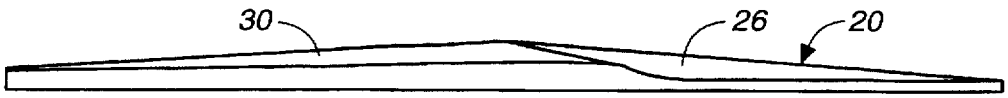
FIG. 11 is an elevational view along line 11—11 in FIG. 9.

By way of example, a standardized faceplate disk 20 is generally 45 mm in diameter. The height of dimension A is 1.8 mm and dimension B is 2.45 mm (FIG. 9A). The height of dimension C is 1.8 mm and dimension D is 2.7 mm (FIG. 9B). The height of dimension E is 1.5 mm and dimension F is 1.9 mm (FIG. 9C).

The standardized faceplate disk is level on the bottom surface 27 for mating with the leveled perimeter 740. Preferably, the faceplate disk has a color that is properly matched to the color of the user's ear. To more closely match the appearance of the user's ear, colored fibers (i.e., red fibers for user's having blood vessels evident near the surface of the skin) can be added to the faceplate disk material.

Figure 13:
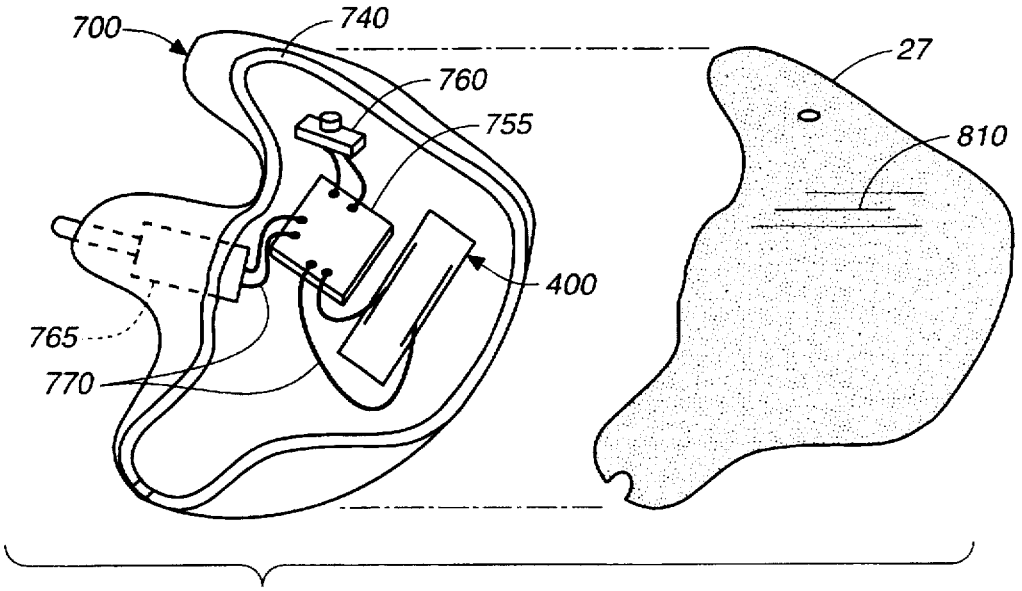
FIG. 13 is an exploded schematic view of the shell and a trimmed faceplate.
Figure 15:
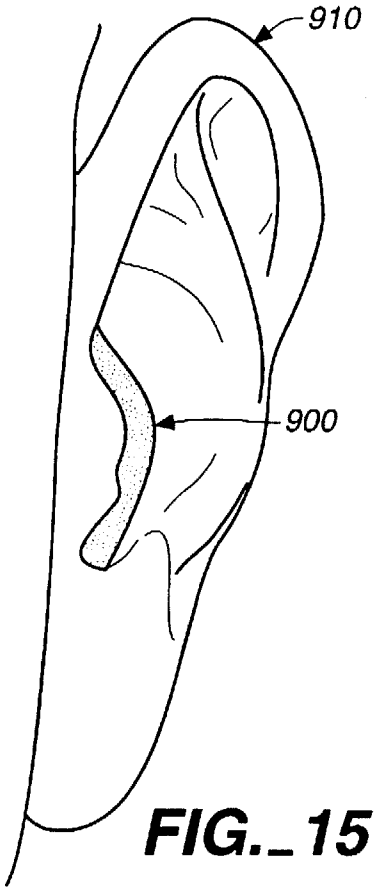
FIG. 15 is a front elevational view of the hearing aid housing worn in a left ear.

FIG. 13 is an exploded perspective view of the hearing aid shell 700 and faceplate 27. Faceplate disk 27 is aligned on the hearing aid shell 700 such that the faceplate 27 will replicate the contours of the user's ear when the hearing aid is placed in the user's ear (FIGS. 14 and 15). Generally, the ridge 810 and an imaginary plane passing vertically through the battery compartment assembly 400 form an acute angle of approximately 50° to 70°, but this is highly dependent on the individual user's ear and customized hearing aid shell, thus many other angles are possible. Prior to mounting and trimming the faceplate disk on the shell 700, ventilation holes are made in the shell 700 by techniques commonly known in the art. Next, the electronic components (e.g., amplifier, microphone, etc.) are glued in their appropriate locations within the hearing aid shell 700. The electronic components, including a battery subassembly 400 with an enclosed battery, an amplifier 755, a microphone 760, a receiver 765, and the accompanying electrical connections 770 are positioned within shell 700 as shown in FIG. 13. Faceplate disk 20 is glued onto trimmed perimeter 740 then trimmed, sanded and buffed. Faceplate 27 results from the trimming, sanding and buffing steps. Finally, the hearing aid housing is finished by steps commonly known in the art. The completed hearing aid 900 fits comfortably within the user's ear 910 and closely matches the color and contours of the user's ear (See FIGS. 14 and 15).

It will be understood that the foregoing is only illustrative of the principles of the present invention, and that various modifications can be made by those skilled in the art without departing from the scope and spirit of the claimed invention. For example, the standardized faceplates can be produced by plastic injection molding techniques instead of the UV radiation process.

We claim:

1. A standardized faceplate representing a contour of a typical ear for use on a customized hearing aid, said faceplate comprising:

a ridge rising from a lower surface of the faceplate and extending from an outside edge of the faceplate to an intermediate position, the ridge representing a radix helicis of the typical ear;

at least one raised contour rising from the lower surface spaced from the ridge and extending from the outside edge of the faceplate to a second intermediate position; and a valley connecting the ridge to the raised contour, the valley representing a cavum conchae of the typical ear.

2. The standardized faceplate of claim 1, further comprising:

a second raised contour rising from the lower surface spaced from the ridge on a side opposite of the raised contour and extending from the outside edge of the faceplate to a third intermediate position; and a second valley connecting the ridge to the second raised contour, the second valley representing a cimba conchae of the typical ear.

3. The standardized faceplate of claim 1 wherein the faceplate is cast radiation-reactive material.

4. The standardized faceplate of claim 1 further comprising:

a customized in-the-ear hearing aid shell having electrical components therein attached to a second side of the lower surface opposite of a first side on which the ridge is located.

* * * * *